US007000354B2

(12) United States Patent
Beaudoin et al.

(10) Patent No.: US 7,000,354 B2
(45) Date of Patent: Feb. 21, 2006

(54) CABLE FAILURE DEVICE FOR GARAGE DOORS AND THE LIKE AND DOOR INCLUDING THE SAME

(75) Inventors: Michel Beaudoin, Drummondville (CA); Érik Nadeau, Lévis (CA); Pierre-Louis Foucault, St-Lambert (CA); Jean-François Lévesque, St-Nicéphore (CA)

(73) Assignee: Canimex Inc., Quebec (CA)

( * ) Notice: Subject to any disclaimer, the term of this patent is extended or adjusted under 35 U.S.C. 154(b) by 89 days.

(21) Appl. No.: 10/765,303

(22) Filed: Jan. 27, 2004

(65) Prior Publication Data

US 2004/0182007 A1 Sep. 23, 2004

(30) Foreign Application Priority Data

Feb. 19, 2003 (CA) ..... 2419185

(51) Int. Cl.
*E05D 13/00* (2006.01)

(52) U.S. Cl. ..... 49/322

(58) Field of Classification Search ..... 49/197, 49/199, 200, 322; 160/188, 189, 192, 193, 160/201, 207

See application file for complete search history.

(56) References Cited

U.S. PATENT DOCUMENTS

| | | | |
|---|---|---|---|
| 2,185,828 A | 1/1940 | Blodgett | 20/19 |
| 4,385,471 A | 5/1983 | Gabry et al. | 49/322 |
| 4,604,828 A | 8/1986 | Baarse | 49/322 |
| 4,956,938 A | 9/1990 | DeMent | 49/28 |
| 5,291,686 A | 3/1994 | Sears et al. | 49/322 |
| 5,704,166 A | 1/1998 | Tam et al. | 49/322 |
| 5,791,686 A | 8/1998 | Moriyama | 280/777 |

(Continued)

FOREIGN PATENT DOCUMENTS

DE 2735123 2/1979

(Continued)

*Primary Examiner*—Jerry Redman
(74) *Attorney, Agent, or Firm*—Merchant & Gould P.C.

(57) ABSTRACT

A cable failure device for a cable-operated door operated by a tensioned cable, the cable-operated door having a movement guided along a fixed structure, such as a guide rail. The cable failure device is configured for cooperating with the tensioned cable so as to immobilize the cable-operated door with respect to the fixed structure in the event of a loss of tension in the cable. The cable failure device included a support bracket for mounting the cable failure device onto the door, a guiding assembly operatively mounted for guiding the movement of the door along the fixed structure, and a braking assembly operatively mounted onto the support bracket, and operable between a rest position where the guiding assembly is allowed to guide the door along the fixed structure, and an operable position triggered by a given loss of tension detected in the tension cable where the braking assembly engages a portion of the fixed structure for braking movement of the cable-operated door with respect to the fixed structure. The cable failure device also includes a safety arm operatively connected to the braking assembly and cooperating with the tensioned cable so as to detect the given loss of tension. The safety arm is operable between a safety configuration where it is positioned over at least one fastener of a corresponding hole of the support bracket when there is still a given tension in the tensioned cable, for preventing a user from removing the support bracket from the door, and a retracted configuration where the safety arm is positioned away from the fastener when the given tension is no longer present in the cable, thereby enabling the user access to the fastener. Thus, the cable failure device is configured for immobilizing the door in the event of a loss of tension and for preventing a user from removing the device from the door when there is still tension in the cable.

20 Claims, 7 Drawing Sheets

U.S. PATENT DOCUMENTS

| | | | | |
|---|---|---|---|---|
| 6,042,158 | A | 3/2000 | Horn | 292/165 |
| 6,189,266 | B1 | 2/2001 | Mihalcheon | 49/322 |
| 6,279,268 | B1 | 8/2001 | Beaudoin et al. | 49/322 |
| 6,553,716 | B1 * | 4/2003 | Bruns | 49/322 |

FOREIGN PATENT DOCUMENTS

| | | |
|---|---|---|
| DE | 3710237 | 10/1988 |
| DE | 3800789 | 7/1989 |
| EP | 0149692 | 7/1985 |
| EP | 0172351 | 2/1986 |
| EP | 0678641 | 10/1995 |
| EP | 0721043 | 7/1996 |
| FR | 2758157 | 7/1998 |
| WO | 03023173 | 3/2003 |

* cited by examiner

CABLE FAILURE DEVICE FOR GARAGE DOORS AND THE LIKE AND DOOR INCLUDING THE SAME

FIELD OF THE INVENTION

The present invention relates to a cable failure device, and to a door including the same. More particularly, the present invention relates to a braking device for use with a cable-operated door, such as garage doors and the like. Namely, it is intended to hold the garage door in position in case of a rupture of one of the cables or in case of a failure of one of the elements that hold the cables, which is represented by a loss of tension in the cable(s) Furthermore, the cable failure device is devised so as to not be able to be removed from the door when there is still tension in the cable with which it cooperates.

BACKGROUND OF THE INVENTION

Cable-operated doors such as garage doors are well known in the art. A garage door is usually connected to an overhead counterbalancing mechanism that provides a counterbalancing force in order to decrease the force required to open the door and also facilitate its closing. A conventional garage door is typically connected to the counterbalancing mechanism by means of two cables, one at the right and one at the left. The cables are usually made of steel. The lower free end of each cable is usually attached at the bottom of the door.

It is also known in the art that a garage door needs to have a proper counterbalancing system so that it may be easily opened and closed. The counterbalancing force is generally achieved by the usage of either one or many torsional springs. Each torsional spring is generally connected to two plugs, a first one being the "winding plug" at one end of the spring, and a second one being the "stationary plug" at the other end of the spring. The winding plug is generally in turn fixed onto the shaft while the stationary plug is generally fixed onto a fixed structure, such as a bearing plate mounted to a wall for example. To transmit the force to the door, there are generally two drums on the shaft of the counterbalancing mechanism on which cables are installed. The extremities of these cables are generally fixed onto bottom brackets, one on each side (left and right) of the door, typically at the last panel of a sectional door for example.

One could envisage that although very unlikely, it might happen that one of the elements (e.g. spring) of the counterbalancing system undergoes a failure, leading to the garage door falling which is undesirable. There have been many attempts to come up with devices used for such an event.

Known in the art are the following US patents and foreign patent applications which describe various cable failure devices for garage doors and the like:

U.S. Pat. No. 6,279,268 B1; U.S. Pat. No. 6,189,266 B1; U.S. Pat. No. 6,042,158; U.S. Pat. No. 5,791,686; U.S. Pat. No. 5,704,166; U.S. Pat. No. 5,291,686; U.S. Pat. No. 4,956,938; U.S. Pat. No. 4,604,828; U.S. Pat. No. 4,385,471; U.S. Pat. No. 2,185,828; EP 721043 A1; EP 678641 A1; EP 172351 A1; EP 149692 A1; DE 3800789 A1; DE 3710237 A1; and FR 2758157 A1.

However, some of the devices taught in the above-mentioned documents are known to be fairly bulky; difficult to install, use, and/or maintain; expensive to manufacture and/or assemble; and generally not offering optimal efficiency for stopping downward movement of a cable-operated door, such as garage doors and the like, in the event of a failure of one of the cables holding such cable-operated door or in the event of a failure of one of the elements holding the cables. Moreover, most of the devices taught in the above-mentioned documents are not provided with additional safety features designed to prevent a user from tampering with and/or removing the device from the door when there is still tension in the cable, and thus prevent the user from being subject to undesirable effects as a result of substantial tension being still present in the cables.

Hence, in light of the above-discussed, there is a need for an improved cable failure device which would be able to overcome some of the aforementioned prior art problems.

SUMMARY OF THE INVENTION

The object of the present invention is to provide a cable failure device which, by virtue of its design and components, satisfies some of the above-mentioned needs, and which is thus an improvement over other cable failure devices known in the prior art.

In accordance with the present invention, the above object is achieved with a cable failure device for a cable-operated door operated by a tensioned cable, the cable-operated door having a movement guided along a fixed structure, the fixed structure having an inner portion and an outer portion, the cable failure device being mountable onto the cable-operated door and being configured for cooperating with the tensioned cable so as to immobilize the cable-operated door with respect to the fixed structure in the event of a loss of tension in the cable, the cable failure device comprising:

- a support bracket mountable onto a bottom portion of the cable-operated door, the support bracket comprising:
  - at least one hole for receiving each a corresponding fastener for securely mounting the support bracket onto the cable-operated door; and
  - a connection point onto which an extremity of the tensioned cable is connected;
- a guiding assembly operatively mounted onto the support bracket for guiding the movement of the cable-operated door along the fixed structure, the guiding assembly travelling along the inner portion of the fixed structure;
- a braking assembly operatively mounted onto the support bracket, the braking assembly being operable between a rest position where the guiding assembly is allowed to guide the cable-operated door along the fixed structure, and an operable position triggered by a given loss of tension detected in the tensioned cable where the braking assembly engages a portion of the fixed structure for braking movement of the cable-operated door with respect to the fixed structure; and
- a safety arm operatively connected to the braking assembly and cooperating with the tensioned cable so as to detect said given loss of tension, the safety arm being operable between a safety configuration where it is positioned over at least one fastener of said at least one hole of the support bracket when there is still a given tension in the tensioned cable, for preventing a user from removing the support bracket from the cable-operated door, and a retracted configuration where the safety arm is positioned away from said at least one fastener when said given tension is no longer present in the cable, thereby enabling the user access to said at least one fastener.

According to another aspect of the invention, there is also provided a cable-operated door operated by a tensioned cable, the cable-operated door having a movement guided along a fixed structure, the fixed structure having an inner portion and an outer portion, the cable-operated door comprising a cable failure device configured for cooperating with the tensioned cable so as to immobilize the cable-operated door with respect to the fixed structure in the event of a loss of tension in the cable, the cable failure device comprising:

a support bracket mounted onto a bottom portion of the cable-operated door, the support bracket comprising:

at least one hole receiving each a corresponding fastener for securely mounting the support bracket onto the cable-operated door; and a connection point onto which an extremity of the tensioned cable is connected;

a guiding assembly operatively mounted onto the support bracket for guiding the movement of the cable-operated door along the fixed structure, the guiding assembly travelling along the inner portion of the fixed structure;

a braking assembly operatively mounted onto the support bracket, the braking assembly being operable between a rest position where the guiding assembly is allowed to guide the cable-operated door along the fixed structure, and an operable position triggered by a given loss of tension detected in the tensioned cable where the braking assembly engages a portion of the fixed structure for braking movement of the cable-operated door with respect to the fixed structure; and a safety arm operatively connected to the braking assembly and cooperating with the tensioned cable so as to detect said given loss of tension, the safety arm being operable between a safety configuration where it is positioned over at least one fastener of said at least one hole of the support bracket when there is still a given tension in the tensioned cable, for preventing a user from removing the support bracket from the cable-operated door, and a retracted configuration where the safety arm is positioned away from said at least one fastener when said given tension is no longer present in the cable, thereby enabling the user to access said at least one fastener.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF A PREFERRED EMBODIMENT OF THE INVENTION

Figure 1:
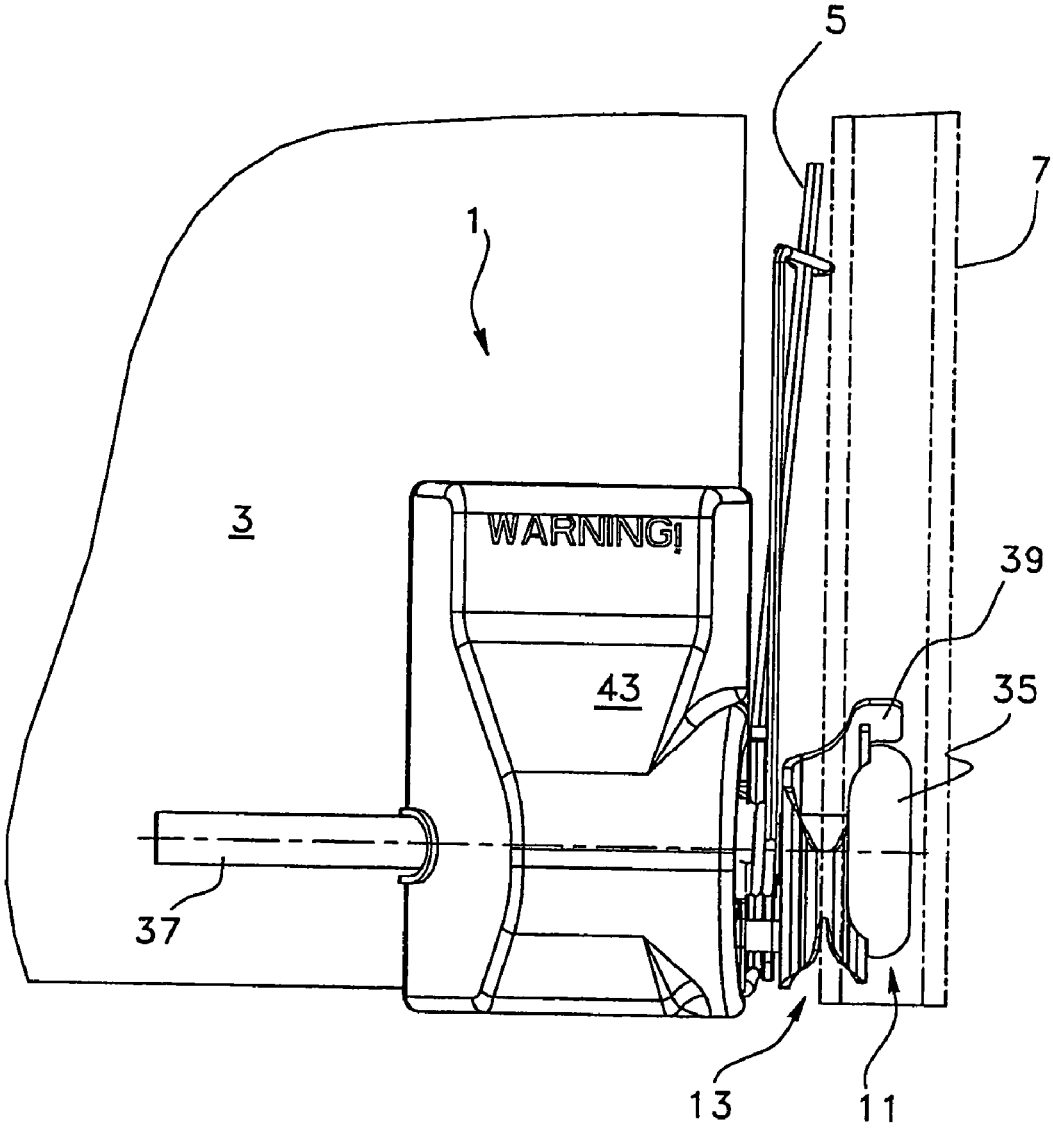
FIG. 1 is a fragmentary view of a cable-operated door provided with a cable failure device according to a preferred embodiment of the present invention, said cable failure device being shown cooperating with a tensioned cable and a fixed structure.

In the following description, the same numerical references refer to similar elements. The embodiments shown in the figures are preferred.

Moreover, although the present invention was primarily designed for use with a cable-operated door, such as a garage door for example, it may be used with other types of doors and objects and in other fields, as apparent to a person skilled in the art. For this reason, expressions such as "cable", "garage", "door", etc., as used herein should not be taken as to limit the scope of the present invention and includes all other kinds of doors and/or items with which the present invention could be used and may be useful.

Moreover, in the context of the present invention, the expressions "driving mechanism", "controlling mechanism", "counterbalancing mechanism", and any other equivalent expression known in the art will be used interchangeably. Furthermore, the same applies for any other mutually equivalent expressions, such as "cable-operated door" and "garage door", "safety arm" and "lever arm", as well as "braking" and "slowing down descent rate" for example, as also apparent to a person skilled in the art.

In addition, although the preferred embodiment of the present invention as illustrated in the accompanying drawings comprises various components such as a block, a shaft, a roller, a spring, a casing, a guiding channel, etc., and although the preferred embodiment of the cable failure device 1 as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the cable failure device 1 and corresponding parts according to the present invention, as briefly explained and inferred herein, without departing from the scope of the invention.

Broadly described, the cable failure device 1 according to the present invention, as shown in the accompanying drawings, is a device 1 for use with a cable-operated door 3, such as garage doors 3 and the like, and it is intended to hold the garage door 3 in position in the event of a failure in the counterbalancing mechanism of the cable-operated door 3, such as, for example, a rupture of one of the cables 5 or a failure of one of the elements holding the cables 5, which is generally represented by a loss of tension in the cables 5 operating the cable-operated door 3. The cable failure device 1 according to the present invention is intended to reduce the possibility of the garage door 3 falling all the way down in the event of a failure of the counterbalancing system.

Indeed, according to the present invention, the cable failure device 1 is intended for a cable-operated door 3 operated by a tensioned cable 5, the cable-operated door 3 having a movement guided along a fixed structure 7, such as a guide rail for example, as better shown in FIGS. 1–6, the fixed structure 7 having an inner portion 7*a* and an outer portion 7*b*. The cable failure device 1 is devised to be mountable onto the cable-operated door 3, at a suitable location thereon, and is configured for cooperating with the tensioned cable 5 so as to immobilize the cable-operated door 3 with respect to the fixed structure 7 in the event of a loss of tension in the cable 5, which represents typically a failure in the counterbalancing mechanism (not shown) of the door 3 such as, as aforementioned, a rupture of one of the cables 5, a failure of one of the elements holding the cables 5 of the counterbalancing mechanism, and/or other similar situations, as apparent to a person skilled in the art.

Figure 7:
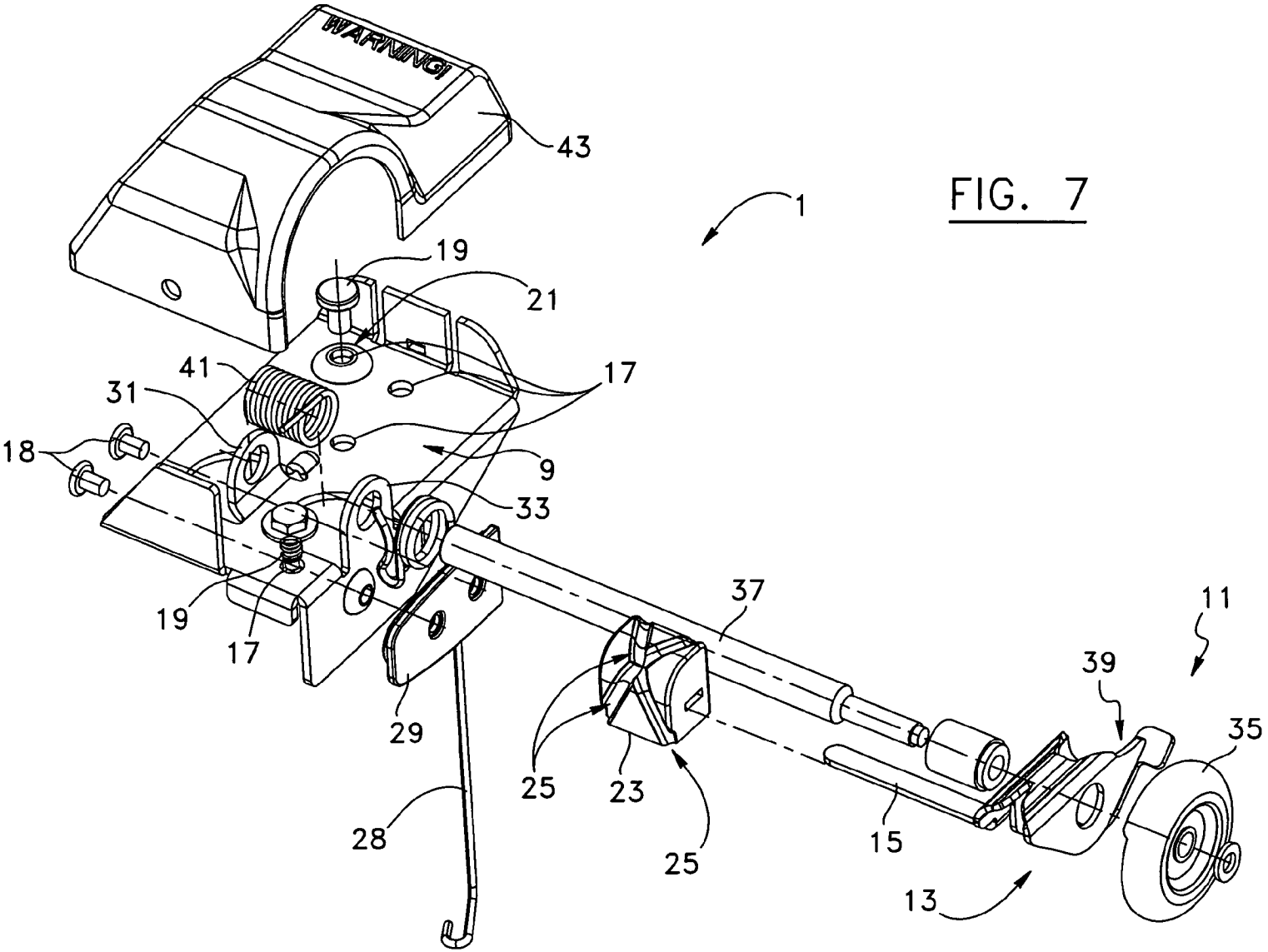
FIG. 7 is an exploded view of the components of the cable failure device shown in FIG. 3.
Figure 8:
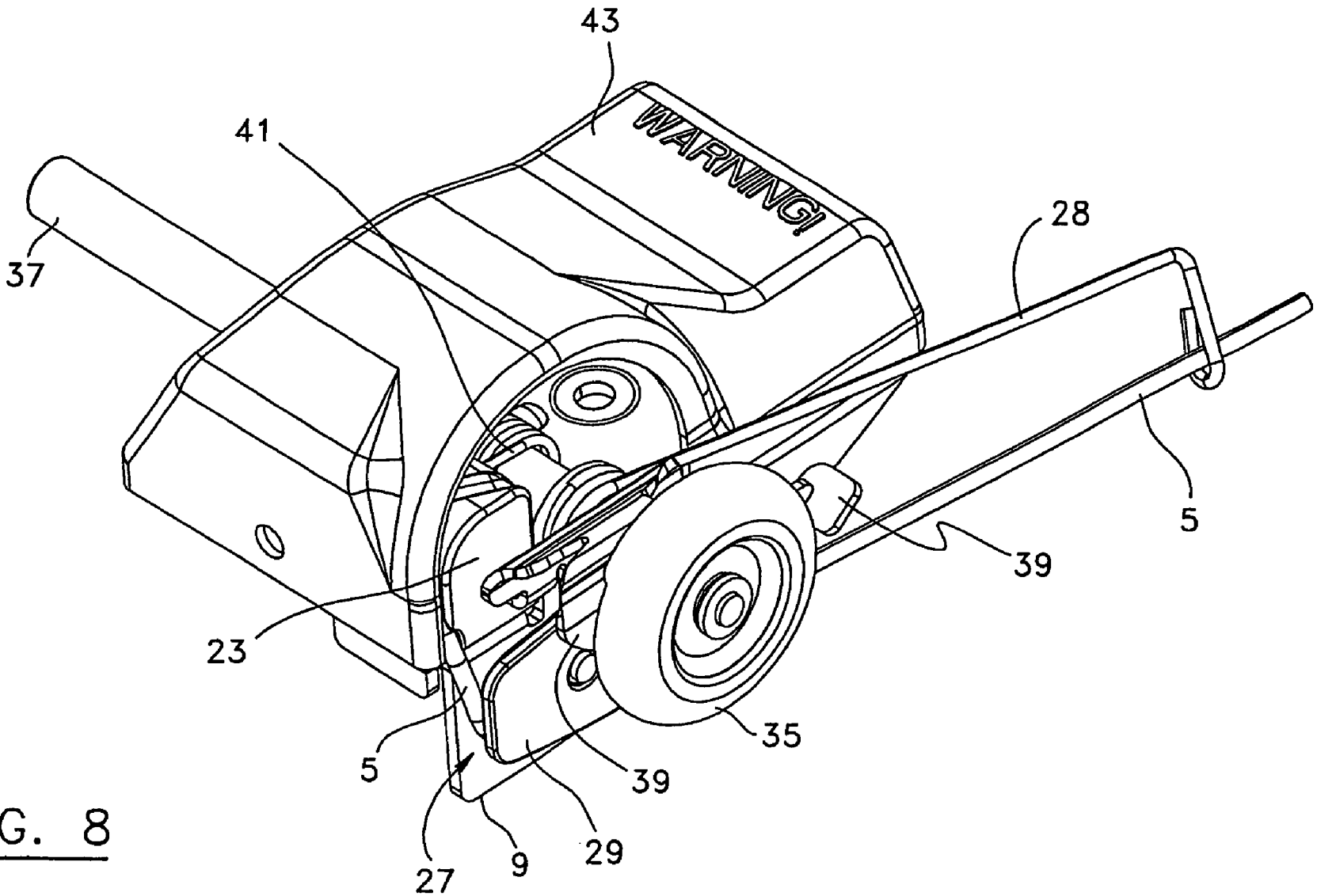
FIG. 8 is a perspective view of a cable failure device according to yet another preferred embodiment of the present invention, said cable failure device being shown cooperating with a tensioned cable.

As better shown in FIG. 7, the cable failure device 1 comprises a support bracket 9, a guiding assembly 11, a braking assembly 13, and a safety arm 15.

Figure 2:
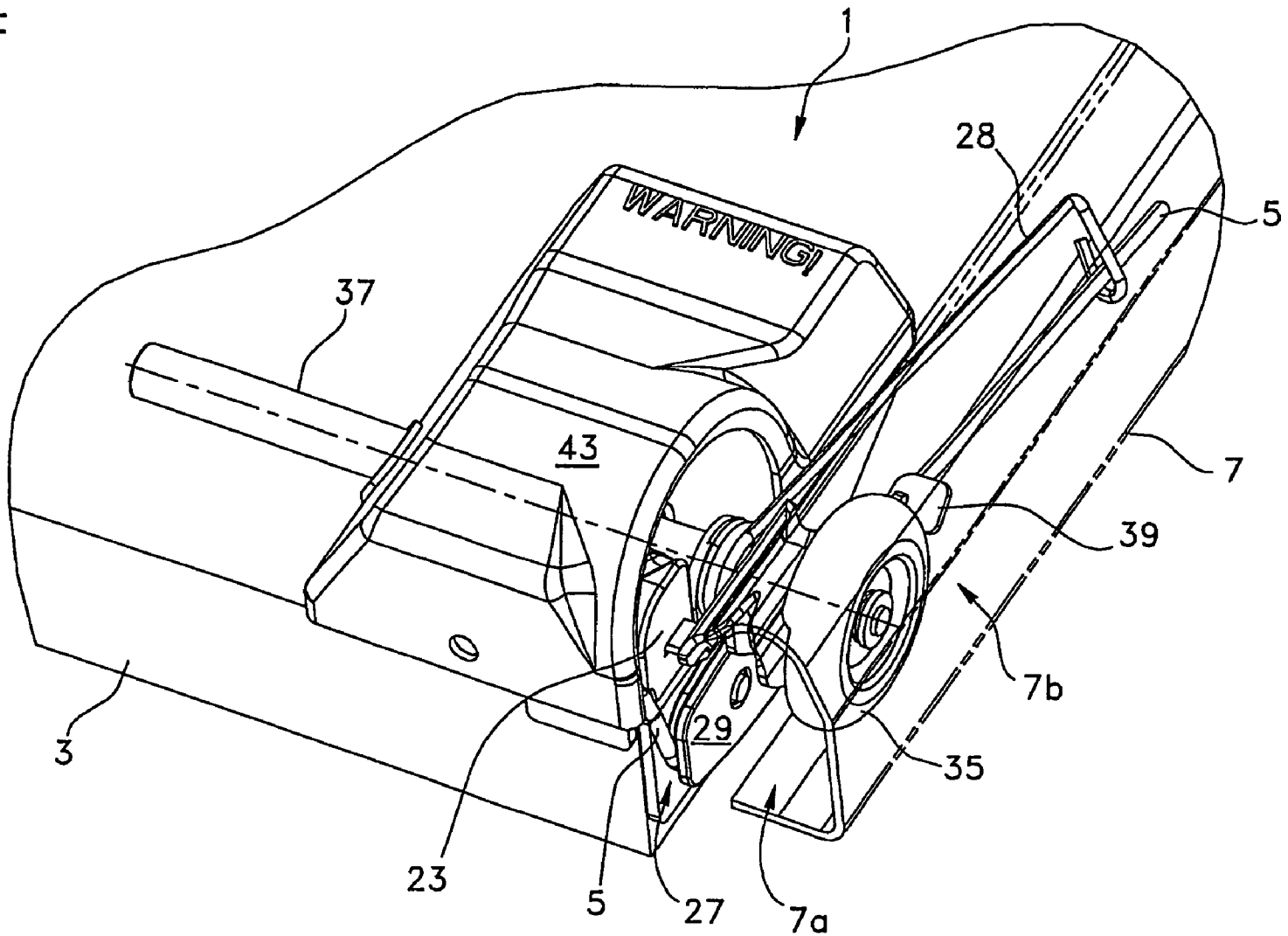
FIG. 2 is a perspective view of what is shown in FIG. 1.

As can be easily understood when referring to FIGS. 1 and 2, the support bracket 9 is mountable onto preferably a bottom portion of the cable-operated door 3, and comprises at least one hole 17 for receiving each a corresponding fastener 19 for securely mounting the support bracket 9 onto the cable-operated door 3, and a connection point 21 onto which an extremity of the tensioned cable 5 is connected.

As also better shown in FIGS. 6–10, the cable failure device 1 preferably comprises guiding means for guiding the tensioned cable 5 about the support bracket 9 and onto the connection point 21 thereof. Preferably, the guiding means comprise a block 23 which is slidably mountable onto the safety arm 15, as better shown in FIG. 7, and which is preferably provided with at least one recess 25 for receiving and guiding the tensioned cable 5 onto the connection point 21 of the support bracket 9, as better shown in FIGS. 6–10.

Preferably also, the guiding means comprise a guiding channel 27 disposed along a side portion of the support bracket 9, as better shown in FIGS. 6–10, for guiding the tensioned cable 5 onto said at least one recess 25 of the block 23 mounted onto the safety arm 15. Preferably also, the cable failure device 1 comprises a side plate 29 which is removably connectable onto the side portion of the support bracket 9, preferably by means of suitable fasteners 18, so as to define the guiding channel 27 therein, as can be easily understood from FIG. 7.

It is worth mentioning that the guiding means may be a single component or various components (e.g. part 28 also), and may be made separate to the support bracket 9, as shown in the accompanying drawings, or could be made integral to the support bracket 9, as apparent to a person skilled in the art.

Figure 3:
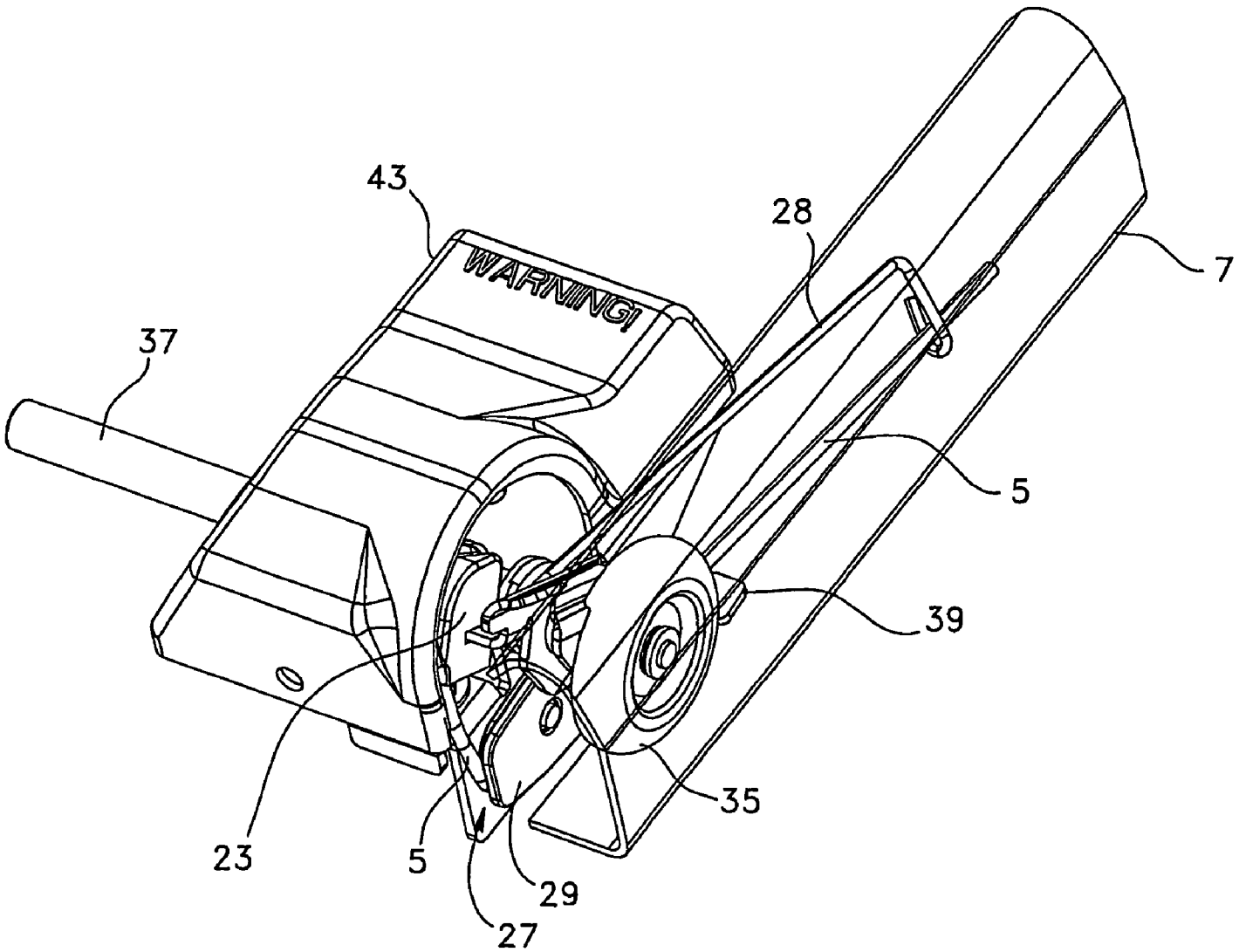
FIG. 3 is a perspective view of the cable failure device, tensioned cable, and fixed structure shown in FIG. 2.
Figure 5:
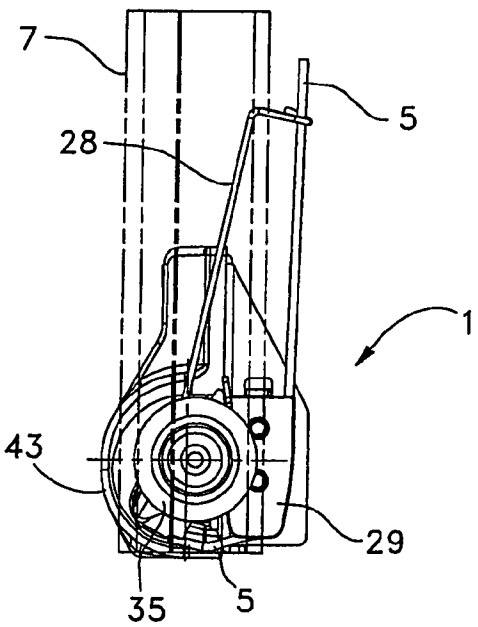
FIG. 5 is a side elevational view of what is shown in FIG. 3.
Figure 4:
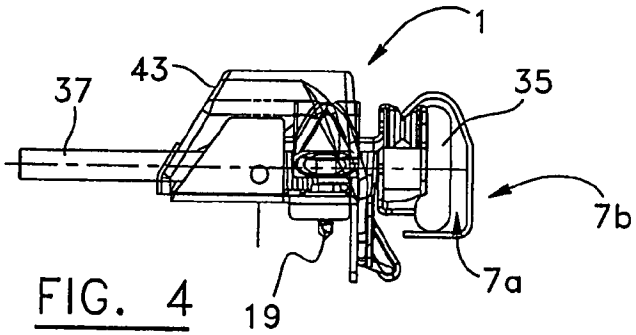
FIG. 4 is a bottom plan view of what is shown in FIG. 3.

As also better shown in FIG. 7, and as can be easily understood when referring to FIGS. 1–6, the guiding assembly 11 is operatively mounted onto the support bracket 9 for guiding the movement of the cable-operated door 3 along the fixed structure 7, the guiding assembly 11 travelling preferably along the inner portion 7a of the fixed structure 7, as better illustrated in FIGS. 2–4.

As shown and as can be easily understood from the accompanying drawings, the braking assembly 13 of the cable failure device 1 is operatively mounted onto the support bracket 9 and is operable between a rest position and an operable position (not shown). In the rest position, the guiding assembly 11 is allowed to guide the cable-operated door 3 along the fixed structure 7, as can be easily understood from FIGS. 1–6, whereas in the operable position, triggered by a given loss of tension detected in the tensioned cable 5 by suitable means, the braking assembly 13 engages a portion of the fixed structure 7 for braking movement of the cable-operated door 3 with respect to the fixed structure 7, in a suitable manner, as is known in the art and as apparent to a person skilled in the art.

Preferably, the support bracket 9 comprises first and second support arms 31, 33, as better shown in FIG. 7, and the guiding means preferably comprise a roller 35 mounted about a shaft 37, the shaft 37 being mounted onto the first and second support arms 31, 33 of the support bracket 9, as also better illustrated in FIG. 7. It is worth mentioning that the roller 35 may be pivotally mounted about the shaft 37, and that said shaft 37 may be made integral to the support bracket 9, but preferably, the shaft 37 is pivotally mounted onto the support arm and the roller 35 is securely mounted about said shaft 37 (e.g. by press fitting) so that when the shaft 37 rotates, so does the roller 35. However, as apparent to a person skilled in the art, other dispositions between the shaft 37, roller 35, and support bracket 9, along with other components, may be made so as to enable the roller 35 to properly guide the cable-operated door 3 along the fixed structure 7, without departing from the scope of the present invention.

As better shown in FIG. 7, the braking assembly 13 preferably comprises a braking plate 39, which is preferably pivotally mounted about the shaft 37 between the second support arm 33 and the roller 35, and is preferably rigidly connected to the safety arm 15, as also better shown in FIG. 7. The braking plate 39 is preferably shaped and sized for travelling along the inner portion 7*a* of the fixed structure 7 when the braking assembly 13 is in the rest position and is also further shaped and sized for engaging a portion of the fixed structure 7 when the braking assembly 13 is triggered into an operable position, so as to immobilize the cable-operated door 3 with respect to the fixed structure 7, namely the guide rail, in a suitable manner as is known in the art and as apparent to a person skilled in the art.

An important innovative aspect of the present invention resides in the fact the cable failure device 1 comprises a safety arm 15 operatively connected to the braking assembly 13 and cooperating with the tensioned cable 5 so as to detect the given loss of tension, which would represent a corresponding failure of the counterbalancing mechanism of the door 3, as previously discussed. The safety arm 15 is operable between a safety configuration (shown in the figures) where it is positioned over at least one fastener 19 of said at least one hole 17 of the support bracket 9 when there is still a given tension in the tensioned cable 5, for preventing a user from removing the support bracket 9 from the cable-operated door 3. The safety arm 15 is further operable in a retracted configuration where the safety arm 15 is positioned away from said at least one fastener 19 when the given tension is no longer present in the cable 5 (either due to a failure of the counterbalancing mechanism or after the tension has been safely removed from the counterbalancing mechanism), so as to enable the user to work on the cable failure device 1 only when there is no longer any tension, and thus reducing the chance of the user from being adversely affected as a result of tension still being present in the cable 5. Thus, as may now be better appreciated, the cable failure device 1 according to the present invention, by virtue of its design and components, namely its safety arm 15, is intended to prevent a user from tampering with and/or removing the device 1 from the door 3 when there is still tension in the cable 5, and is thus intended to prevent a user from being adversely affected as a result of substantial tension being still present in the cables 5. Moreover, as will be briefly explained hereinafter, the safety arm 15 also acts as a lever arm 15 when the braking assembly 13 is triggered into an operable position.

Figure 6:
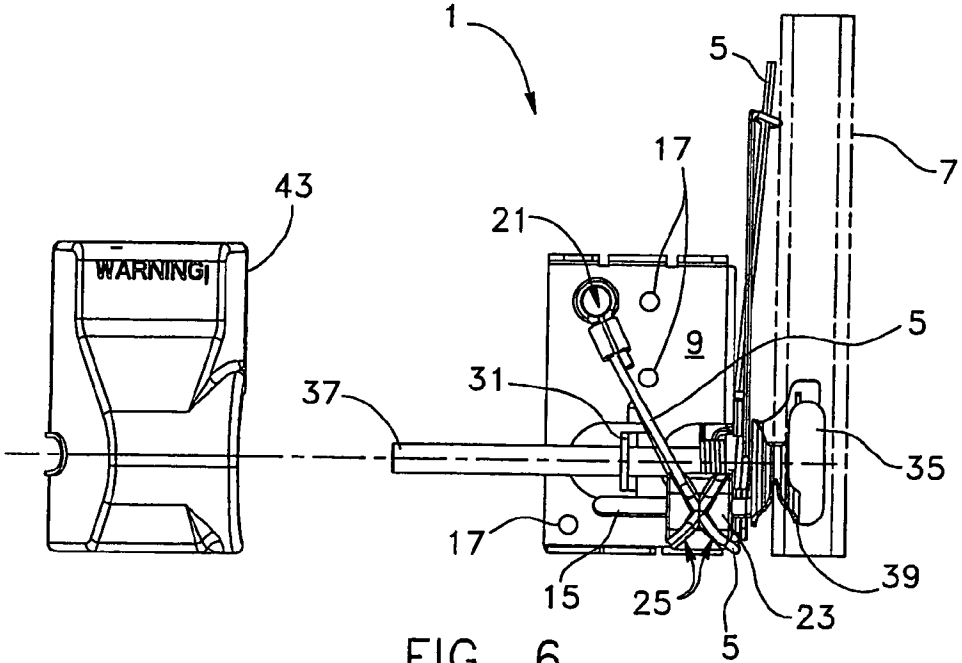
FIG. 6 is a front plan view of what is shown in FIG. 5, the casing of the cable failure device being shown in an exploded relationship.
Figure 10:
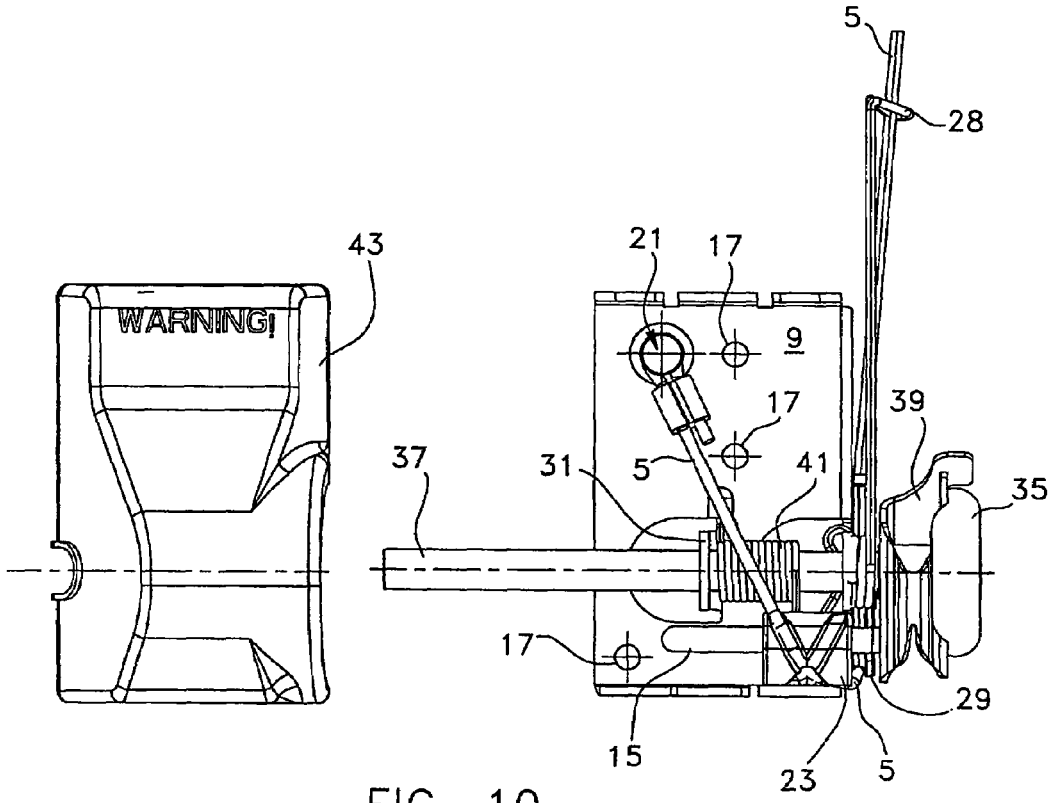
FIG. 10 is a front plan view of what is shown in FIG. 8, the casing of the cable failure device being shown in an exploded relationship.
Figure 9:
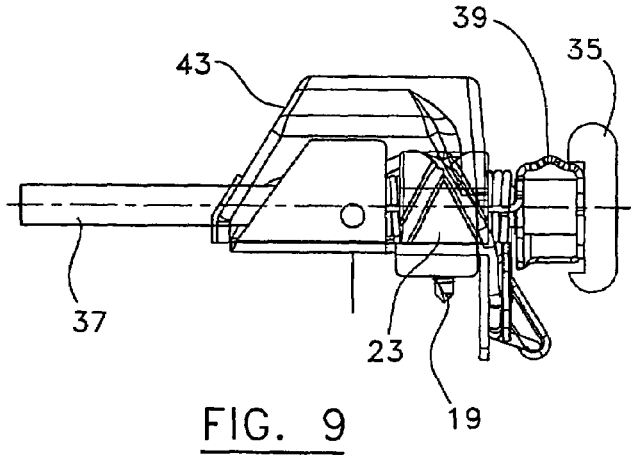
FIG. 9 is a bottom plan view of what is shown in FIG. 8.

Indeed, as better shown in FIG. 7, the braking assembly 13 preferably comprises biasing means for biasing the braking assembly 13 into an operable position when said given loss of tension is detected by the safety arm 15, as can be understood from FIGS. 6 and 10.

Preferably, the biasing means comprise a spring 41 having one end operatively connected to the support bracket 9 and another end operatively connected to the braking plate 39 via the safety arm 15, for urging the braking plate 39 to engage the fixed structure 7 when said given loss of tension is detected by the safety arm 15, that is when the braking assembly 13 is triggered into an operable position. According to the preferred embodiment of the present invention, said other end of the spring 41 is preferably connected to the block 23 mounted onto the safety arm 15, as better shown in FIGS. 7, 8, and 10.

It is worth mentioning though that several modifications could be made to the present cable failure device 1 according to the present invention without departing from the scope of the present invention. Indeed, although the biasing means preferably comprise a loaded spring 41, capable of storing potential energy via deformation so as to provide a potential force urging the safety arm 15, and thus the braking plate 39, into a braking mode, in the event of a loss of tension in the cable 5, it is worth mentioning however that other suitable biasing means which do not use potential energy for providing a biasing force may be used according to the present invention, so long as these biasing means are capable of biasing the safety arm 15 and corresponding braking plate 39 in a suitable way in the manner discussed above, and as apparent to a person skilled in the art.

Moreover, it is worth mentioning that the biasing means may have other suitable dispositions on the cable failure device 1 so as to ensure a corresponding biasing force on the braking plate 39, via the safety arm 15, according to the present invention. It is worth mentioning also that, according to the present invention, the spring member is not absolutely necessary for proper operation of the cable failure device 1. Indeed, in an alternate embodiment, the biasing means could ultimately consist of the effect of gravity acting on the braking plate 39 for example, in the event of a loss of tension in the tension cable 5, in which case, the braking plate 39, and corresponding safety arm 15 rigidly connected thereto, would be positioned, shaped, and sized onto the shaft 37 of the guiding assembly 11, so that, by virtue of the effect of gravity acting thereon, as apparent to a person skilled in the art, it would cause the braking plate 39 to engage with the fixed structure 7 in the event of a loss of tension in the tensioned cable 5, as described above and as also apparent to a person skilled in the art.

It is worth mentioning also that, according to the present invention, the different various components of the cable failure device 1 may be disposed otherwise on the support bracket 9, as also apparent to a person skilled in the art.

Referring to FIG. 7, there is shown how the cable failure device 1 is preferably provided with a casing 43 which is removably mountable onto the support bracket 9 for substantially covering the support bracket 9 and other components operatively connected thereto, such as the support arms 31, 33, the spring 41, the block 23, the safety arm 15, the connection point 21, etc. The casing 43 may be provided with suitable visual information for example, such as the expression "warning" for instance, as illustrated in the figures, or other expressions and/or symbols conveying information.

According to another aspect of the present invention, there is also provided a door 3 provided with a cable failure device 1 such as the one described herein.

As can be easily understood from the accompanying drawings, when the braking plate 39 is in the rest position, the roller 35 of the cable failure device 1 will guide the door 3 along the rail and the braking plate 39 will travel freely therealong inside the rail. When the braking plate 39 is triggered into the operable position by a loss of tension in the cable 5, corresponding to a failure in the counterbalancing mechanism for example, said loss of tension is detected by the safety arm 15, which in turn acts as a lever arm 15. Namely, the force of the actuating spring 41 becomes greater than the force that was acted upon by the tensioned cable 5 against the safety arm 15, thereby causing the actuating lever arm 15 (i.e. safety arm 15) which is preferably rigidly connected to the braking plate 39 to rotate the same and thus engage it inside of the rail, thereby urging the brake plate 39 against the rail and thus thereby preventing and/or slowing down substantially downward movement of the garage door 3, as apparent to a person skilled in the art. As can be easily understood, this combined action brakes the movement of the cable-operated door 3 and thus is intended to break its free falling to the ground, which is advantageous.

As may now be better appreciated, the cable failure device 1 according to the present invention preferably comprises several safety features. For example, as better shown in FIGS. 1–10, the cable failure safety device 1 preferably comprises a protective casing 43 removably mountable onto the support bracket 9 by suitable attachment means, for protecting the mechanism of the cable failure device 1 and for preventing an unskilled user from tampering with the mechanism. Moreover as can be easily understood from the accompanying drawings, the safety arm/lever arm 15 used with the biasing means of the cable failure device 1 is preferably shaped, sized and positioned to conceal at least one of the fasteners 19 used for mounting the cable failure device 1 onto the garage door 3 when acted upon by the tensioned cable 5, as better shown in FIGS. 1–6, so as to prevent an unskilled user to remove the cable failure device 1 from the garage door 3 when there is still substantial tension in the cable 5. Indeed, the tension from the cable 5 must be removed so that the lever arm 15 may be safely raised, and thus have access to said at least one fastener 19.

Moreover, the device 1 shown in the accompanying figures is a "right" cable failure device 1 to be located at the bottom of the garage door 3, more specifically at the right-hand side thereof when viewed from the inside of the garage. A "left" cable failure device 1, that is, a left-hand side version of the cable failure device 1 shown, would simply be a mirror image of what is in the accompanying figures. Each cable failure device 1, whether right or left, is preferably devised to hold at least half of the load of the garage door 3 and is tightly attached to its corresponding tensioned cables 5.

Furthermore, the present invention is a substantial improvement over the prior art in that, by virtue of its design and components, the cable failure device 1 is very simple and easy to use, as well as is very simple and easy to manufacture and/or assemble, without compromising the reliability of its functions. Hence, it may now be appreciated that the present invention represents important advantages over other cable failure devices known in the prior art, in terms of performance and in terms of costs.

The present invention is also an improvement and presents several advantages over other cable failure brakes known on the prior art in that it may be used in the garage door industry, with new garage doors 3 or existing garage doors 3, whether commercial or residential. Indeed, in the case of a cable failure, the present invention is intended to stop the fall of the garage door 3 and to maintain it immobilized where it is until the necessary inspections and repairs are made. As it is evident from reading the above description, the present invention is a cable failure device 1 used for braking a cable-operated door 3, such as garage doors 3 and the like, in the event of a failure of one of the cables 5 operating such cable-operated door 3 or in the event of a failure of one of the elements holding the cables 5. The present invention is also a more compact, more reliable, easier to use, easier to maintain and more cost effective device 1 than those available in the prior art. Furthermore, the present invention may be used with other kinds of doors 3, such as slidable truck doors 3, or with any other items suspended by a cable 5, as apparent to a person skilled in the art.

Of course, numerous modifications could be made to the above-described embodiments without departing from the scope of the invention, as apparent to a person skilled in the art.

What is claimed is:

1. A cable failure device for a cable-operated door operated by a tensioned cable, the cable-operated door having a movement guided along a fixed structure, the fixed structure having an inner portion and an outer portion, the cable failure device being mountable onto the cable-operated door and being configured for cooperating with the tensioned cable so as to immobilize the cable-operated door with respect to the fixed structure in the event of a loss of tension in the cable, the cable failure device comprising:

a support bracket mountable onto a bottom portion of the cable-operated door, the support bracket comprising:

at least one hole for receiving each a corresponding fastener for securely mounting the support bracket onto the cable-operated door; and a connection point onto which an extremity of the tensioned cable is connected;

a guiding assembly operatively mounted onto the support bracket for guiding the movement of the cable-operated door along the fixed structure, the guiding assembly travelling along the inner portion of the fixed structure;

a braking assembly operatively mounted onto the support bracket, the braking assembly being operable between a rest position where the guiding assembly is allowed to guide the cable-operated door along the fixed structure, and an operable position triggered by a given loss of tension detected in the tensioned cable where the braking assembly engages a portion of the fixed structure for braking movement of the cable-operated door with respect to the fixed structure; and a safety arm operatively connected to the braking assembly and cooperating with the tensioned cable so as to detect said given loss of tension, the safety arm being operable between a safety configuration where it is positioned over at least one fastener of said at least one hole of the support bracket when there is still a given tension in the tensioned cable, for preventing a user from removing the support bracket from the cable-operated door, and a retracted configuration where the safety arm is positioned away from said at least one fastener when said given tension is no longer present in the cable, thereby enabling the user to access said at least one fastener.

2. A cable failure device according to claim 1, wherein the cable failure device comprises guiding means for guiding the tensioned cable about the support bracket and onto the connection point thereof.

3. A cable failure device according to claim 2, wherein the guiding means comprises a block slidably mountable onto the safety arm, the block being provided with at least one recess for receiving and guiding the tensioned cable onto the connection point of the support bracket.

4. A cable failure device according to claim 2, wherein the guiding means comprises a guiding channel disposed along a side portion of the support bracket, for guiding the tensioned cable onto said at least one recess of the block mounted onto the safety arm.

5. A cable failure device according to claim 4, wherein the cable failure device comprises a side plate removably connectable onto the side portion of the support bracket so as to define the guiding channel.

6. A cable failure device according to claim 1, wherein the support bracket comprises first and second support arms, and wherein the guiding assembly comprises a roller mounted about a shaft, said shaft being mounted onto the first and second support arms of the support bracket.

7. A cable failure device according to claim 6, wherein the braking assembly comprises a braking plate, pivotably mounted about the shaft between the second support arm and the roller, and rigidly connected to the safety arm, the braking plate being shaped and sized for travelling along the inner portion of the fixed structure when the braking assembly is in the rest position and for engaging a portion of the fixed structure when the braking assembly is triggered into an operable position, so as to immobilize the cable-operated door with respect to the fixed structure.

8. A cable failure device according to claim 1, wherein the braking assembly comprising biasing means for biasing the braking assembly into an operable position when said given loss of tension is detected by the safety arm.

9. A cable failure device according to claim 8, wherein the biasing means comprise a spring having one end operatively connected to the support bracket and another end operatively connected to the braking plate via the safety arm, for urging the braking plate to engage the fixed structure when said given loss of tension is detected by the safety arm.

10. A cable failure device according to claim 9, wherein said another end of the spring is connected to the block mounted onto the safety arm.

11. A cable failure device according to claim 1, wherein the cable failure device comprises a casing removably mountable onto the support bracket for substantially covering the support bracket and other components operatively connected thereto.

12. A cable-operated door operated by a tensioned cable, the cable-operated door having a movement guided along a fixed structure, the fixed structure having an inner portion and an outer portion, the cable-operated door comprising a cable failure device configured for cooperating with the tensioned cable so as to immobilize the cable-operated door with respect to the fixed structure in the event of a loss of tension in the cable, the cable failure device comprising:

a support bracket mounted onto a bottom portion of the cable-operated door, the support bracket comprising:

at least one hole receiving each a corresponding fastener for securely mounting the support bracket onto the cable-operated door; and a connection point onto which an extremity of the tensioned cable is connected;

a guiding assembly operatively mounted onto the support bracket for guiding the movement of the cable-operated door along the fixed structure, the guiding assembly travelling along the inner portion of the fixed structure;

a braking assembly operatively mounted onto the support bracket, the braking assembly being operable between a rest position where the guiding assembly is allowed to guide the cable-operated door along the fixed structure, and an operable position triggered by a given loss of tension detected in the tensioned cable where the braking assembly engages a portion of the fixed structure for braking movement of the cable-operated door with respect to the fixed structure; and a safety arm operatively connected to the braking assembly and cooperating with the tensioned cable so as to detect said given loss of tension, the safety arm being operable between a safety configuration where it is positioned over at least one fastener of said at least one hole of the support bracket when there is still a given tension in the tensioned cable, for preventing a user from removing the support bracket from the cable-operated door, and a retracted configuration where the safety arm is positioned away from said at least one fastener when said given tension is no longer present in the cable, thereby enabling the user to access said at least one fastener.

13. A cable-operated door according to claim 12, wherein the cable failure device comprises guiding means for guiding the tensioned cable about the support bracket and onto the connection point thereof.

14. A cable-operated door according to claim 13, wherein the guiding means comprises a block slidably mountable onto the safety arm, the block being provided with at least one recess for receiving and guiding the tensioned cable onto the connection point of the support bracket, and wherein the guiding means further comprises a guiding channel disposed along a side portion of the support bracket, for guiding the tensioned cable onto said at least one recess of the block mounted onto the safety arm.

15. A cable-operated door according to claim 14, wherein the cable failure device comprises a side plate removably connectable onto the side portion of the support bracket so as to define the guiding channel.

16. A cable-operated door according to claim 12, wherein the support bracket comprises first and second support arms, and wherein the guiding assembly comprises a roller mounted about a shaft, said shaft being mounted onto the first and second support arms of the support bracket.

17. A cable-operated door according to claim 16, wherein the braking assembly comprises a braking plate, pivotably mounted about the shaft between the second support arm and the roller, and rigidly connected to the safety arm, the braking plate being shaped and sized for travelling along the inner portion of the fixed structure when the braking assembly is in the rest position and for engaging a portion of the fixed structure when the braking assembly is triggered into an operable position, so as to immobilize the cable-operated door with respect to the fixed structure.

18. A cable-operated door according to claim 12, wherein the braking assembly comprising biasing means for biasing the braking assembly into an operable position when said given loss of tension is detected by the safety arm.

19. A cable-operated door according to claim 18, wherein the biasing means comprise a spring having one end operatively connected to the support bracket and another end operatively connected to the braking plate via the safety arm, for urging the braking plate to engage the fixed structure when said given loss of tension is detected by the safety arm.

20. A cable-operated door according to claim 12, wherein the cable failure device comprises a casing removably mountable onto the support bracket for substantially covering the support bracket and other components operatively connected thereto.

* * * * *